US009797402B2

(12) United States Patent
Jankowski et al.

(10) Patent No.: US 9,797,402 B2
(45) Date of Patent: Oct. 24, 2017

(54) COOLING DEVICES AND METHODS FOR USE WITH ELECTRIC SUBMERSIBLE PUMPS

(71) Applicants: Todd Andrew Jankowski, Los Alamos, NM (US); Jose A Gamboa, Houston, TX (US)

(72) Inventors: Todd Andrew Jankowski, Los Alamos, NM (US); Jose A Gamboa, Houston, TX (US)

(73) Assignees: CHEVRON U.S.A. INC., San Ramon, CA (US); LOS ALAMOS NATIONAL SECURITY, LLC, Los Alamos, NM (US)

( * ) Notice: Subject to any disclaimer, the term of this patent is extended or adjusted under 35 U.S.C. 154(b) by 385 days.

(21) Appl. No.: 14/577,926

(22) Filed: Dec. 19, 2014

(65) Prior Publication Data

US 2015/0139822 A1 May 21, 2015

Related U.S. Application Data

(63) Continuation-in-part of application No. 14/540,882, filed on Nov. 13, 2014, now Pat. No. 9,394,917, (Continued)

(51) Int. Cl.

| | |
|---|---|
| ***F04D 13/08*** | (2006.01) |
| ***F04D 13/10*** | (2006.01) |
| ***F25B 27/00*** | (2006.01) |
| ***F25B 1/00*** | (2006.01) |
| ***F04D 29/58*** | (2006.01) |
| *F25B 1/053* | (2006.01) |

(52) U.S. Cl.

CPC ..... *F04D 13/086* (2013.01); *F04D 13/10* (2013.01); *F04D 29/5806* (2013.01); *F25B 1/005* (2013.01); *F25B 27/00* (2013.01); *F25B 1/053* (2013.01); *F25B 2339/047* (2013.01); *F25B 2400/071* (2013.01)

(58) Field of Classification Search

CPC .... F04D 13/10; F04D 13/086; F04D 29/5806; F04D 29/588; F25B 1/005; F25B 1/053; F25B 27/00; F25B 2339/047; F25B 2400/071

USPC ..... 417/366, 369, 371; 29/586, 588

See application file for complete search history.

(56) References Cited

U.S. PATENT DOCUMENTS

| | | | |
|---|---|---|---|
| 1,947,630 | A | 2/1934 | Wernert |
| 2,244,255 | A | 6/1941 | Looman |

(Continued)

OTHER PUBLICATIONS

International Search Report from Corresponding PCT Application No. PCT/US2012/60877 dated Jan. 11, 2013.

(Continued)

*Primary Examiner* — Devon Kramer
*Assistant Examiner* — Christopher Brunjes
(74) *Attorney, Agent, or Firm* — King & Spalding LLP

(57) ABSTRACT

Cooling devices for use with electric submersible pump motors include a refrigerator attached to the end of the electric submersible pump motor with the evaporator heat exchanger accepting all or a portion of the heat load from the motor. The cooling device can be a self-contained bolt-on unit, so that minimal design changes to existing motors are required.

15 Claims, 9 Drawing Sheets

Related U.S. Application Data which is a continuation of application No. 13/655,328, filed on Oct. 18, 2012, now Pat. No. 8,899,054.

(60) Provisional application No. 61/548,353, filed on Oct. 18, 2011.

(56) References Cited

U.S. PATENT DOCUMENTS

| | | | | |
|---|---|---|---|---|
| 2,503,456 | A | 4/1950 | Smith | |
| 3,443,641 | A | 5/1969 | McComb | |
| 4,610,793 | A | 9/1986 | Miller | |
| 4,704,823 | A * | 11/1987 | Steinback | B24B 7/06 451/261 |
| 5,477,703 | A | 12/1995 | Hanchar et al. | |
| 5,609,478 | A * | 3/1997 | Utter | F04C 18/023 418/55.5 |
| 5,694,780 | A | 12/1997 | Alsenz | |
| 6,561,775 | B1 | 5/2003 | Wefers | |
| 6,769,487 | B2 | 8/2004 | Hache | |
| 7,661,460 | B1 | 2/2010 | Cowans | |
| 2003/0132003 | A1 | 7/2003 | Arauz et al. | |
| 2004/0112601 | A1 * | 6/2004 | Hache | E21B 36/001 166/302 |
| 2004/0256109 | A1 | 12/2004 | Johnson | |
| 2005/0089419 | A1 * | 4/2005 | Arauz | E21B 43/128 417/420 |
| 2009/0151928 | A1 * | 6/2009 | Lawson | B01D 19/0057 166/105.5 |
| 2009/0272129 | A1 | 11/2009 | Petty | |
| 2010/0026108 | A1 * | 2/2010 | Hassett | F28D 15/0275 310/54 |
| 2010/0115978 | A1 | 5/2010 | Simka | |
| 2011/0211979 | A1 * | 9/2011 | Schlenhoff | E21B 43/128 417/410.1 |
| 2012/0156079 | A1 * | 6/2012 | Hirata | F04C 28/06 418/201.1 |

OTHER PUBLICATIONS

Written Opinion of the International Search Authority from corresponding PCT Application No. PCT/US2012/60877 dated Jan. 11, 2013.

* cited by examiner

COOLING DEVICES AND METHODS FOR USE WITH ELECTRIC SUBMERSIBLE PUMPS

CROSS-REFERENCE TO RELATED APPLICATIONS

This application is a continuation-in-part of U.S. patent application Ser. No. 14/540,882, filed on Nov. 13, 2014, which is a continuation of U.S. patent application Ser. No. 13/655,328, which was filed on Oct. 18, 2012, which claims the benefit of U.S. Provisional Patent Application No. 61/548,353, which was filed on Oct. 18, 2011. The entire content of each of these applications is incorporated herein by reference in its entirety.

ACKNOWLEDGEMENT OF GOVERNMENT SUPPORT

This invention was made with government support under Contract No. DE-AC52-06NA25396, awarded by the U.S. Department of Energy. The government has certain rights in the invention.

TECHNICAL FIELD

This disclosure relates to cooling devices for use with electric submersible pump (ESP) systems.

PARTIES TO JOINT RESEARCH AGREEMENT

The research work described here was performed under a Cooperative Research and Development Agreement (CRADA) between Los Alamos National Laboratory (LANL) and Chevron under the LANL-Chevron Alliance, CRADA number LA05C10518.

BACKGROUND

Electrical submersible pumps (ESPs) are used in the geothermal, oil and gas and water wells for producing fluids from the subterranean well. Traditionally, subterranean wells are completed in porous formations having naturally high permeability and which contain water, oil, natural gas, heated water, brine and/or steam in relative close proximity to the surface of the earth. Geothermal wells are also completed in low permeability formations that contain little to no geothermal fluid. For these low permeability formations, the permeability of the formation is engineered or enhanced through stimulation methods such as pumping of cold water to generate fractures within the formation. This creates or enhances a geothermal reservoir in the high temperature formation to enable development of an Engineered or Enhanced Geothermal System (EGS).

Currently, ESP systems are not suitable for most high temperature applications, especially geothermal applications. ESP systems are susceptible to pump cavitation due to boiling in high temperature wells producing water and/or brine above 100° C. The temperature of the earth grows hotter with increasing depth, and geothermal systems can have well temperatures ranging from 150° C. to greater than 300° C. Advanced methods for recovering heavy oil may involve the use of steam to mobilize or heat oil and water produced from the reservoir having a temperature above 200° C. ESP systems used to recover oil with hot water in these steam flood wells are exposed to temperatures above design limits of current ESPs.

ESPs are comprised of two main parts, an electric induction motor and a centrifugal pump. The electric motor is used to drive the pump. The motors and pumps both have small aspect ratios (diameter to length ratio), typically 2.75-12 inches in diameter and up to approximately 45 feet long. The pumps are used down-hole in oil-field applications to pump oil from reservoirs to the surface. The ESP is placed in an oil well typically hundreds to thousands of feet underground.

Oil producers have been using ESPs in Steam-Assisted oil-field applications, where the motors and pumps are operating in reservoirs with temperatures exceeding 400° F. As a result of heat generated on the interior of the motor (due to electrical and windage losses) during operation, the interior of the motor may reach temperatures significantly hotter (between 50°–100° F.) than the reservoir temperature. Example embodiments described herein can be used in subterranean wells having high-temperature environments. Such high-temperature environments can include, but are not limited to, deep wells, steam-assisted gravity drainage (SAGD) wells, cyclic steam stimulation (CSS) wells, and steam-flood wells. In addition, or in the alternative, example embodiments can be used in "poor fluid circulation wells" in which the fluid velocity around the motor is too low for keeping an effective internal cooling. Some examples can include, but are not limited to, an ESP installed below the perforations in a wellbore, an ESP installed in large casings, and an ESP installed in gassy wells.

ESP manufacturers all produce a line of 'high temperature ESPs' that are specifically designed to operate in high temperature environments. The design enhancements used in the current state of the art high temperature ESPs primarily focus on material selection (epoxies and insulation) in the motor, so that the electrical components can operate at elevated temperatures. Despite these design enhancements, thermal failures of ESPs are still a significant cost to oil production companies and a significant portion of total production is at risk from ESP failure.

Empirical evidence shows a strong correlation between a reduction in motor operating temperature and increased run life. Empirical evidence from the industry suggests that a 20° F. reduction in peak motor temperature could result in a 50% increase in run life. For ESP motors during operation, the interior components of the motor typically operate at temperatures 50-100° F. higher than the surrounding reservoir temperature. However, if a downhole cooling device (e.g., a refrigerator) can be used to provide a low temperature heat sink downhole, and depending on the capacity of the refrigerator, the internal components of the motor could be cooled to the reservoir temperature or even lower, with proportionate increases in run life.

SUMMARY

Various cooling devices are disclosed herein for use with ESP systems to provide improved performance and functionality of the ESP systems in high temperature environments.

In one embodiment, a cooling device for an electric submersible pumping system is provided. The cooling device can have a generally cylindrical housing having a first end, a second end, a length defined as the distance between the first end and the second end, and a diameter. In addition, the cooling device can include a compressor, a condenser, a pressure reduction device, an evaporator contained within the housing, and a coupling system for powering the compressor from a motor of, for example, the electric submersible pumping system.

In some embodiments, the coupling system can be a magnetic coupling system positioned at the first end of the generally cylindrical housing. The magnetic coupling system can have a first side that can be driven by a motor of the electric submersible pumping system and a second side that can drive a shaft of the compressor. In other embodiments, the generally cylindrical housing can include a compressor housing coupled to an evaporator housing, with the compressor housing generally covering the compressor and the evaporator housing generally covering the evaporator. The compressor housing can include a metal plate that forms part of the magnetic coupling system. The compressor housing can include a plurality of passageways extending from a first side of the compressor housing to a second side of the compressor housing, with the passageways being sized to allow a lubricating fluid from the motor (e.g. oil) to bypass the compressor and flow between the motor of the electric submersible pumping system and the evaporator.

In some embodiments, the evaporator can include a plurality of tubes that substantially extend the length of evaporator housing. The plurality of tubes can have an outer tube, an inner tube, and an annulus defined therebetween. One or more oil supply manifolds can be coupled to the inner tube and the pressure reduction device (e.g., an expansion valve) can be fluidly coupled to the outer tube to deliver a working fluid (e.g., steam) to the annulus between the inner and outer tubes.

Any type of compressor can be used in example embodiments, For example, in some embodiments, the compressor can be a reciprocating compressor, a scroll compressor, or a vane compressor. The compressor can operate on a single phase or multiple phases. The condenser can be a single-pass heat exchanger which rejects heat to an external product stream through the condenser housing. The condenser housing can be finned to facilitate the transfer for heat to the product stream. In some embodiments, the ratio of the length to the diameter of the generally cylindrical housing is at least 15:1 or, in other embodiments, at least 30:1 (or some other ratio greater than 15:1) or, in still other embodiments, less than 15:1.

In another embodiment, a method of cooling a lubricating fluid in a downhole electric submersible pumping system is provided. The method includes coupling a cooling device to the electric submersible pumping system. The cooling device can include a compressor, a condenser, a pressure reduction device, and an evaporator contained within a generally cylindrical housing. The method can further optionally include operatively or directly coupling the cooling device to a motor (for example, on the electric submersible pumping system) to drive a shaft of the compressor, positioning the cooling device downhole with the electric submersible pumping system, operating the electric submersible pumping system, and cooling the lubricating fluid using the cooling device.

In some embodiments, the act of coupling (e.g., directly, operatively) the cooling device to the electric submersible pumping system comprises bolting the two together. The act of operatively coupling the cooling device and the electric submersible pumping system can also include coupling a first side of a magnetic coupling system to the motor of the electric submersible pumping system and coupling a second side of the magnetic coupling system to a shaft of the compressor. The act of cooling the lubricating fluid in the motor of the electric submersible pumping system can include receiving the lubricating fluid from the motor into an inner tube of the evaporator, delivering a working fluid (e.g., steam) in an outer tube of the evaporator that generally surrounds the inner tube, and returning the lubricating fluid from the inner tube of the evaporator back into the motor at a temperature lower than the temperature in which entered the inner tube.

In some embodiments, the acts of receiving and returning the lubricating fluid to and from the inner tube, respectively, comprise bypassing the compressor by delivering the lubricating fluid through a plurality of passageways in the housing. The length of the housing can be at least 15 times the diameter of the housing and the act of cooling the lubricating fluid can include directing the lubricating fluid along a majority of the length of the housing within the inner tube. The condenser can be a single-pass heat exchanger and the method can include rejecting heat from the condenser to a product stream external to the housing.

In another embodiment, a bolt-on refrigerator system is provided. The system includes a generally cylindrical housing, a compressor, and a magnetic coupling system. The generally cylindrical housing has a first end, a second end, a length defined as the distance between the first end and the second end, and a diameter. The generally cylindrical housing also includes a compressor housing portion and a finned evaporator housing portion. The compressor is in the compressor housing portion and a condenser, a pressure reduction device, and an evaporator contained are within a finned evaporator housing portion. The magnetic coupling system is positioned at the first end of the generally cylindrical housing and the magnetic coupling system has a first side that can be driven by an external device and a second side that can drive a shaft of the compressor. The ratio of the length to the diameter of the generally cylindrical housing can be at least 15:1, or in other embodiments, at least 30:1.

In some embodiments, an electric submersible pumping system is coupled to the first end of the bolt-on refrigerator. The electric submersible pumping system includes a motor as the external device that can drive the first side of the magnetic coupling system. A plurality of passageways extending from a first side of the compressor housing to a second side of the compressor housing can also be provided. The passageways can be sized to allow a lubricant from the motor of the electrical submersible pumping system to bypass the compressor and flow between the motor of the electric submersible pumping system and the evaporator.

In other embodiments, an active on-board cooling device (e.g., a refrigerator) for an ESP motor is provided for operating in a high-temperature environment (e.g., SAGD well, steam-flood well, deep well). The refrigerator can provide a low temperature heat sink downhole. When the heat generating components of the motor are allowed to communicate with this low temperature heat sink, the internal components of the ESP motor can operate at temperatures significantly lower than an ESP without the on-board refrigerator. These operating temperature reductions can provide increased reliability and longer run times.

DETAILED DESCRIPTION

The following description is example in nature and is not intended to limit the scope, applicability, or configuration of the invention in any way. Various changes to the described embodiments may be made in the function and arrangement of the elements described herein without departing from the scope of the invention.

As used in this application and in the claims, the terms "a," "an," and "the" include both the singular and plural forms of the element(s) they refer to unless the context clearly dictates otherwise. Additionally, the term "includes" means "comprises." Further, the term "coupled" generally means electrically, electromagnetically, and/or physically (e.g., mechanically or chemically) coupled or linked and does not exclude the presence of intermediate elements between the coupled or associated items absent specific contrary language. Although water/steam is described in certain embodiments, it should be understood that any working fluid with suitable characteristics for a particular application can be used with the cooling devices described herein (e.g., a refrigerator).

Although the operations of example embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Cooling devices for Electric Submersible Pumps (ESPs) are described herein. As described in more detail below, these cooling devices can remove all or at least a portion of the heat load from an ESP motor to lower the internal temperature of the motor and improve its reliability.

Figure 1A:
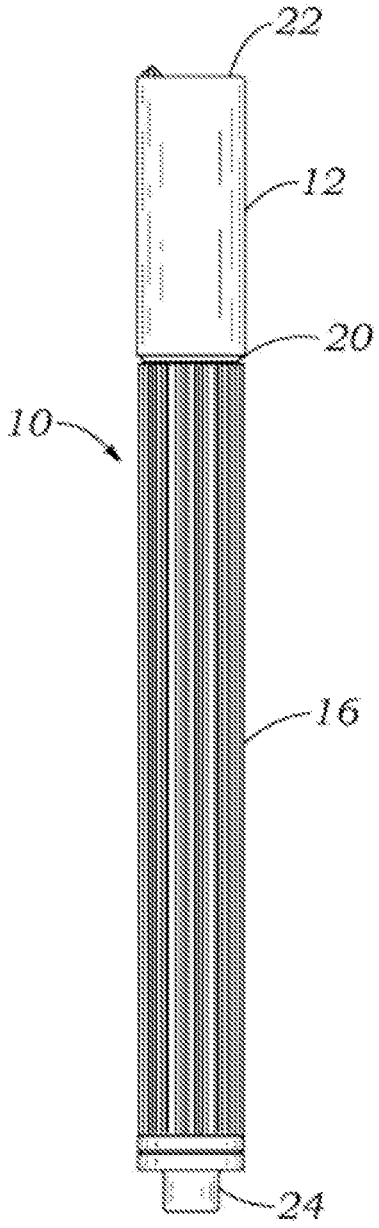
FIG. 1A shows a view of a cooling device for use with an ESP system.
Figure 1B:
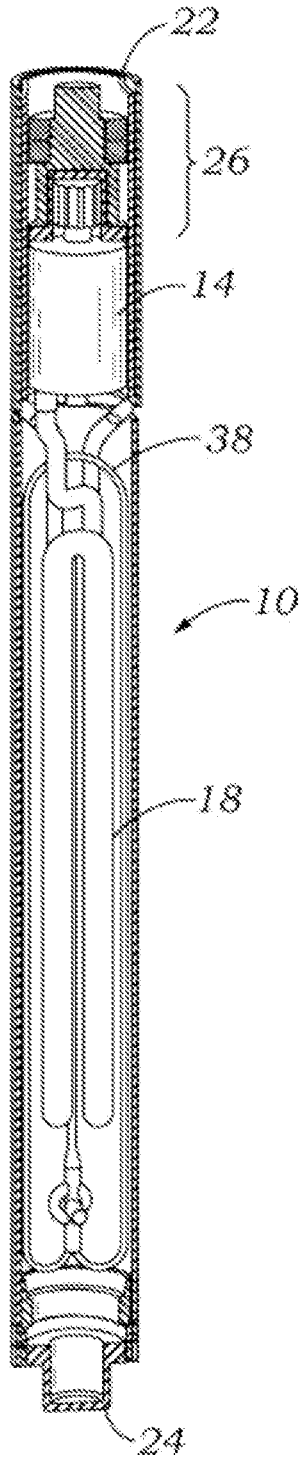
FIG. 1B shows a sectional view of the cooling device shown in FIG. 1A.

FIGS. 1A and 1B illustrate views of a cooling device 10, with FIG. 1B being a cross-sectional view of FIG. 1A. It should be understood that cooling device 10 is not drawn to scale in the figures. In particular, the evaporator and condenser sections (e.g., heat exchanger system 18 shown in FIG. 1B) of cooling device 10 have been significantly shortened relative to other features to allow for easier viewing. In certain example embodiments, the condenser can be physically separated from the evaporator.

In one embodiment, cooling device 10 can be between about 4 and 8 inches in diameter and between 10 and 50 feet long. In a particular embodiment, cooling device 10 can be between about 5.5 and 6.5 inches in diameter and between about 20 and 40 feet long, or more preferably between about 25 and 35 feet long, such as about 6 inches and about 30 feet long. Thus, the ratio of the length to diameter of cooling devices described herein is at least 15:1 (e.g., 8 inches and 10 feet long), and in some embodiments, at least 30:1 (e.g., 8 inches and 20 feet long).

Referring to FIGS. 1A and 1B, cooling unit 10 can be formed to have a plurality of housings that cover, contain, and/or otherwise protect internal areas of cooling unit 10. For example, a compressor housing 12 can cover or contain a compressor system 14. In addition, a second housing, such as finned housing 16, can generally cover a heat exchanger system 18. Housings 12 and 16 can be coupled together, such as by weld joint 20. A first end 22 of cooling device 10 can be configured to be coupled to an ESP system, and the second end can have an end cap 24.

Cooling device 10 can comprise a refrigerator system (e.g., a system that has a compressor, condenser, evaporator, and pressure reduction device) that can be bolted to the end of the ESP motor (not shown) near compressor system 14. In some embodiments, cooling device 10 can be bolted to the ESP motor using a standard flange. The refrigerator system can be sized and configured in such a way as to accommodate an expansion and contraction of the working fluid, even when mixed with the lubricant of the refrigerator system. The refrigeration system (or any other portion of the cooling device 10 that requires power) can receive power from any of a number of power sources. Examples of a power source can include, but are not limited to, a battery, the motor (as defined below with respect to FIGS. 9A-10), and a generator at the surface (provided by a power transmission device, such as a cable).

Figure 2:
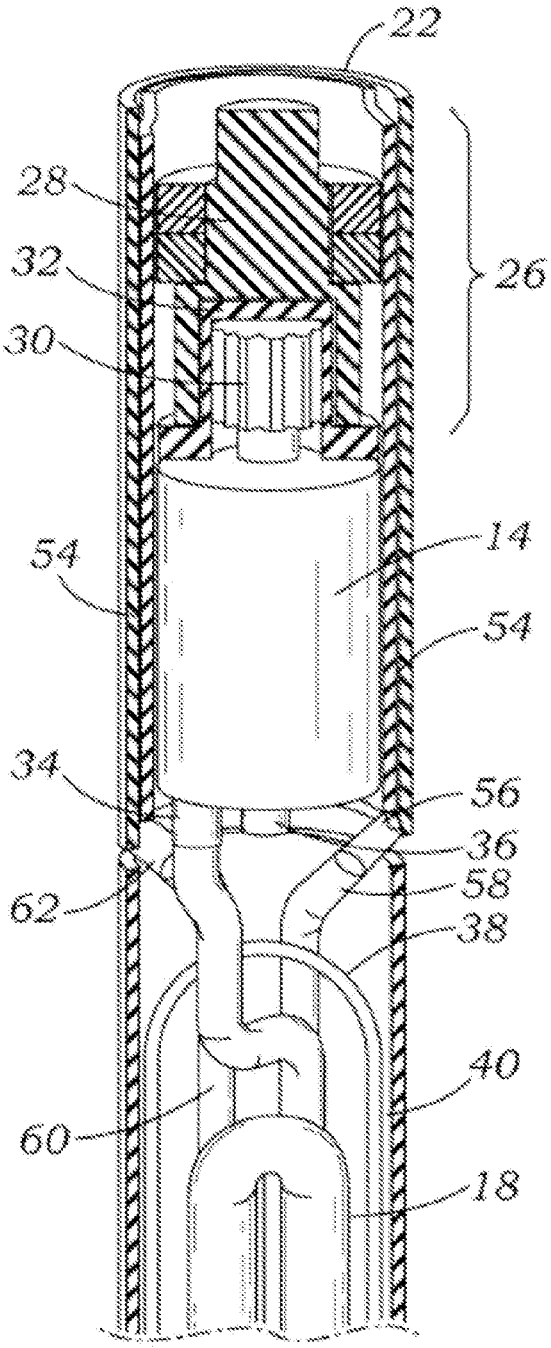
FIG. 2 shows a close-up view of the compressor in the cooling device.

As shown in FIGS. 1A and 2, compressor system 14 can be driven by a magnetic coupling 26. In particular, a female side 28 of magnetic coupling 26 (shown in at the top of FIG. 2) can be driven by the existing motor shaft of the ESP system using a standard spline coupling. A male side 30 of the magnetic coupling 26 can be configured to drive a shaft of compressor system 14.

Figure 5:
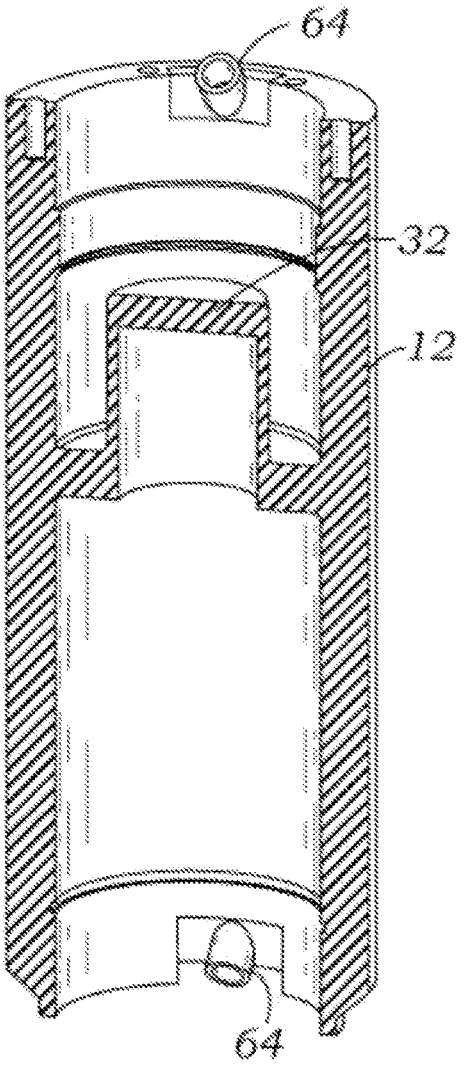
FIG. 5 shows a view of the compressor housing without the compressor or magnetic coupling.

Between the male and female sides 30, 28 of the coupling 26 is a metal plate 32 (e.g., a stainless steel plate). Plate 32 can be machined directly from compressor housing 12. As shown in FIG. 5, plate 32 can be positioned between the two sections of magnetic coupling 26, thereby acting as a pressure boundary between a working fluid (e.g., steam) and an internal motor lubricating fluid (e.g., oil). In this manner, plate 32 forms a portion of the hermetic seal between the working fluid (e.g., steam) and the internal motor oil. In some embodiments, all surfaces separating the working fluid (e.g., steam) and oil are made with welded connections, thereby preventing the working fluid (e.g., steam) steam from contaminating the internal motor oil. As discussed above, the following embodiments describe the working fluid as water/steam; however, it should be understood that, depending on the particular conditions of operation, other suitable working fluids can be used in combination with the cooling devices described herein. For example, water/steam can be well-suited for operation at temperatures, for example, of about 150-250 degrees Celsius, but other working fluids could be more desirable if the cooling device is to be used at temperatures outside of this range.

Magnetic coupling 26 can be based on a design available through MMC Enterprises Corporation, however any suitable coupling may be used. The coupling can be sized for the torque requirements of compressor system 14. For example, in one embodiment, coupling 26 can be selected so that it will function at 3600 rpm and at a working temperature of up to 280° C.

Figure 3:
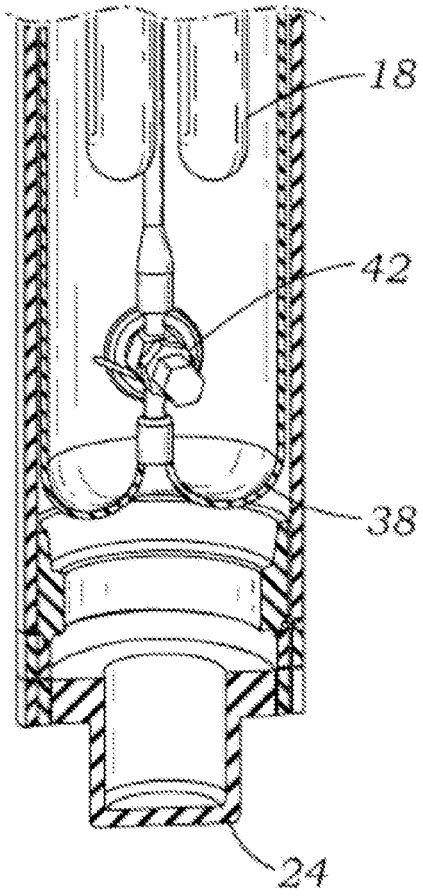
FIG. 3 shows a close-up view of the end of the cooling device with the pressure reduction device.

Referring again to FIG. 2, steam inlet 34 and steam outlet 36 are provided for receiving and delivering a refrigerator working fluid (also called, more simply, working fluid) that can include, but is not limited to, water and a lubricant. These connections to compressor system 14 can be located at the end opposite the drive shaft of the compressor system 14, as shown in FIG. 2. Thus, high temperature steam leaving the compressor outlet 36 can flow over a domed head of a condenser shell 38 and into an annulus 40 between condenser shell 38 and the housing 16 of cooling device 10. As the high temperature vapor enters annulus 40, heat is rejected from the steam through housing 16 of cooling device 10 to an external product stream that flows past housing 16. The resulting high temperature liquid can collect at an outlet of the condenser shown at the bottom of FIG. 3.

Figure 4:
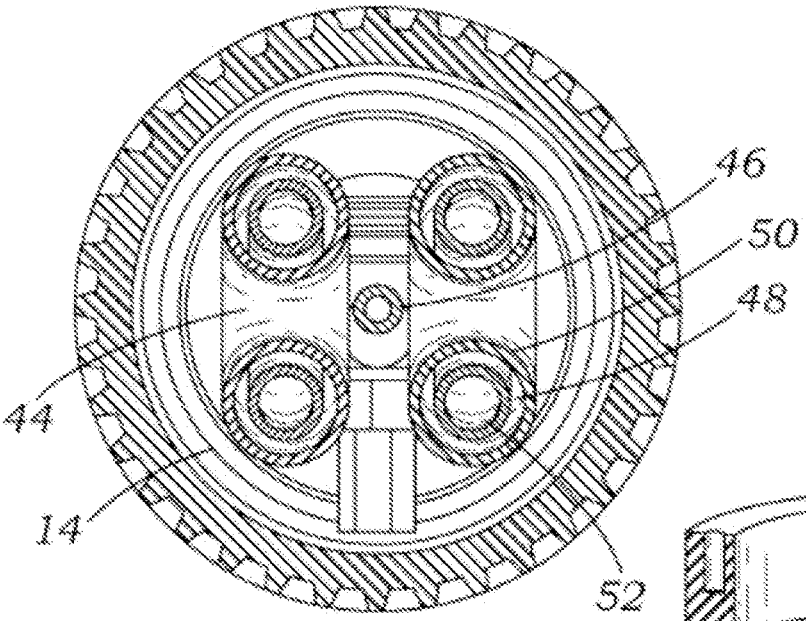
FIG. 4 shows a cross-section of the heat exchanger portion of the cooling device showing the evaporator and condenser heat exchangers.

The high temperature liquid then flows through a pressure drop in a pressure reduction device 42. The low temperature liquid-vapor mixture at the outlet of pressure reduction device 42 is then routed into the evaporator heat exchanger system 18. The low temperature steam leaving pressure reduction device 42 is routed through the four-pass tube-in-tube evaporator heat exchanger 44 shown in FIG. 4. From pressure reduction device 42, the steam first flows through a steam supply tube 46 at the center of the evaporator tube bundle along the full length of the evaporator heat exchanger system 18. At the compressor system 14 end of the heat exchanger system 18, the steam flows into an annulus 48 between an outer steam tube 50 and a tube 52 carrying the motor oil from the ESP. In the annular tube-in-tube section, heat generated in the motor and transferred to the motor oil is transferred from the motor oil to the low temperature steam on the steam side of the evaporator. The tube-in-tube section makes four passes through the evaporator section. At the end of the fourth pass, the steam is routed back to compressor inlet 34, and the low temperature oil flows back into the motor as described in more detail below.

Figure 6:
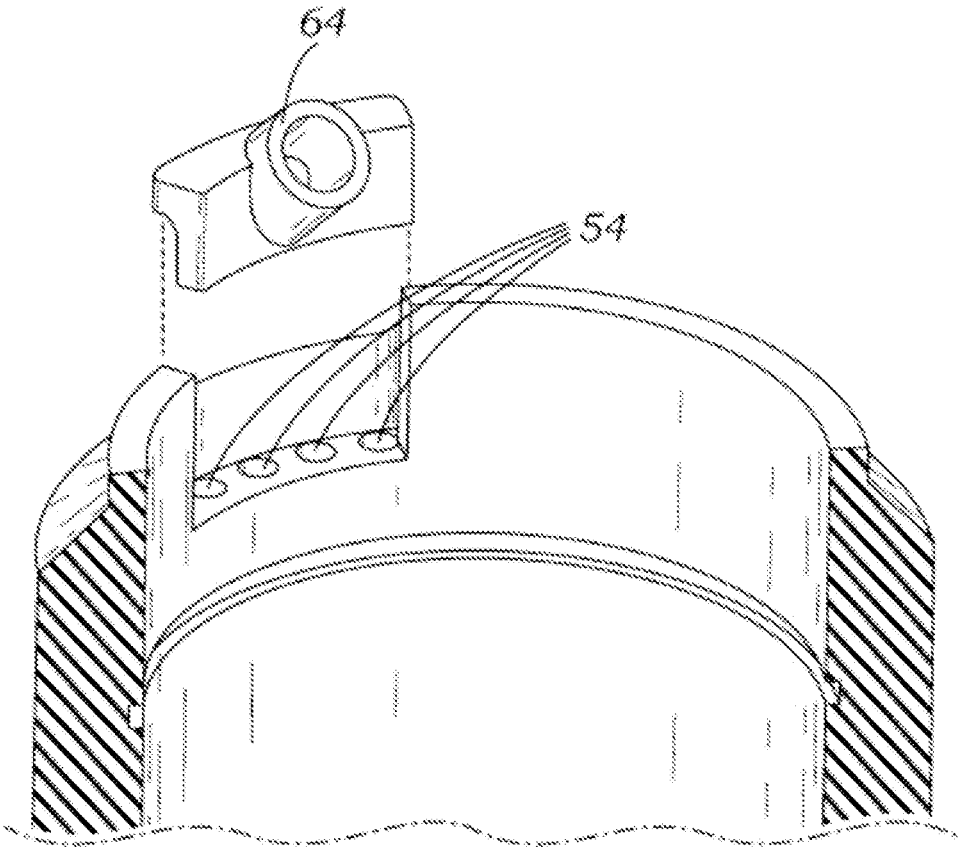
FIG. 6 shows close-up exploded view of the compressor housing with the manifold.

To allow for heat transfer between the steam and the motor oil in the evaporator, the motor oil must flow past the compressor. As shown in FIG. 2, FIG. 5, and FIG. 6 the compressor housing 14 can have one or more passageways 54 (e.g., small axial channels drilled into the housing wall) for oil flow past compressor 14 in each direction. In one embodiment a total of 10¼" diameter passageways (5 on the oil supply and 5 on the oil return) are incorporated into the housing to allow for a substantial flow cross-sectional area to minimize pressure drop in the oil. Oil can be delivered to the evaporator via oil supply passageways 54 to an oil supply manifold 56 and into an oil supply tube 58. To return oil from the evaporator, oil can return through an oil return tube 60, to an oil return manifold 62, and into oil return passageways 54.

As shown in FIG. 6, manifolds 64 (which include oil supply and return manifolds 56, 62) can be provided on either end of compressor 14 to collect the oil from these passageways and to route the oil as necessary. These oil flow passages through the compressor housing 12 allow oil flow from the ESP motor to evaporator heat exchanger system 18.

The cooling device components described herein were developed with the intent of meeting heat transfer, pressure, and assembly requirements. In some embodiments, the refrigerator components can be welded together to ensure that the cooling device does not fail in view of the high differential pressure between the product and steam. In addition, compressor 14 can require most of the internal diameter of the compressor housing 12 which can complicate the oil manifold shown in FIG. 6.

In one embodiment, the compressor housing 12 (including plate 32) can be machined out of a single stainless steel rod, with small bypass holes drilled into compressor housing 12 to allow for oil exchange across housing 12. If desired, a manifold adapter can be welded into housing 12 to connect the bypass holes after the compressor is installed to provide improved structural strength.

Based on the requirements of the cooling device, although other compressors may be used, two types of compressors are preferred. The two preferred compressor types are rotary vane and swash or wobble plate reciprocating. Lubricants which are compatible with steam and capable of withstanding the operating temperatures are preferably used with the cooling device.

As discussed above, the cooling systems disclosed herein can be easily coupled to existing ESP systems. For example, the cooling systems can simply be bolted onto high temperature ESPs. In addition, a mechanical interface for the refrigerator add-on can be provided, such as a spline coupling to the motor shaft to drive the refrigerator's compressor and lubricating oil circulation pump. Currently, ESPs in production are already equipped with this type of spline coupling at the end of the motor to allow for the use of multiple motors in series. The cooling devices described herein take advantage of current configurations of ESP so that they can be readily coupled to the ESPs as, for example, a bolt-on accessory.

An example method of operation of a bolt-on cooling device (e.g., a single stage vapor compression refrigerator with a four component cycle) is described below.

Once coupled to the ESP motor as described above, the vapor compressor of the refrigerator compresses a working fluid (preferably water) from saturated vapor at a low temperature and pressure to a high pressure superheated vapor. The high temperature working fluid can then be directed through a condenser heat exchanger that rejects heat to the reservoir fluids flowing past the motor and refrigerator. Heat rejection from the condenser heat exchanger causes the working fluid to de-superheat and condense to a saturated or slightly subcooled condition at the condenser outlet. The working fluid can be any lubricant or refrigerant. In certain example embodiments, the working fluid is effective in heat transfer at temperatures of approximately 200° C., which is a common operating temperature for ESPs.

The high temperature liquid working fluid can then be directed through a pressure reduction device, which causes a reduction in pressure of the working fluid and a corresponding reduction in temperature. The fluid at the exit of the pressure reduction device is a low temperature two-phase liquid-vapor mixture. This low temperature two-phase mixture can then be routed through an evaporator heat exchanger, where heat can be accepted from a higher temperature heat source such as the internal lubricating oil of the ESP motor that is in contact with the heat generating components of the motor. Heat transfer from the heat source to the working fluid in the evaporator causes the working fluid to evaporate. The fluid leaving the evaporator heat exchanger is a saturated or slightly superheated low temperature vapor that then re-enters the compressor to begin another cycle.

In one embodiment, the evaporator heat exchanger can use a shell and tube heat exchanger with the refrigerant on the tube side and the motor's lubricating oil on the shell side. To transport heat from the heat generating components of the motor to the evaporator heat exchanger, an internal lubricating oil pump can be included on the shell side to circulate the oil axially between the motor and the refrigerator. The condenser heat exchanger can be a falling film design that would give the working fluid a surface to condense; the outside of the condensing surface being cooled by the reservoir fluids flowing axially past the motor housing. The pressure reduction device can be an orifice type expansion device. The compressor can bleed power from the main rotating shaft of the motor. Alternatively, the compressor (or other portion of the cooling device 10) can have a motor that provides power to the compressor. This compressor could be any type of rotary compressor that would fit in the limited diameter of the ESP motor.

Figure 7A:
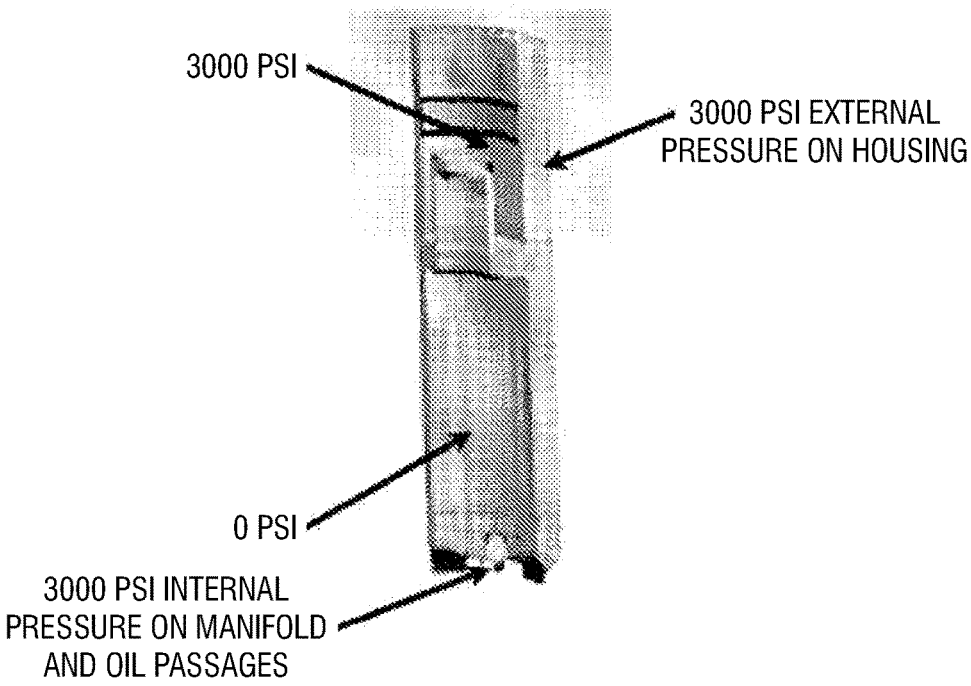
FIGS. 7A and 7B show stress analyses that were performed on components subjected to high pressure.

A finite element structural analysis of the finned refrigerator housing has been performed and the results of the finite element analysis are shown in FIG. 7A. As shown in those figures, maximum stress in the wall of the housing with a 3000 psi external pressure (and 0 psi internal pressure) is calculated as 34 ksi. The yield strength of the carbon steel housings is 75 ksi. The stresses generated in the wall of the finned housing are well below the yield strength of the material.

Figure 7B:
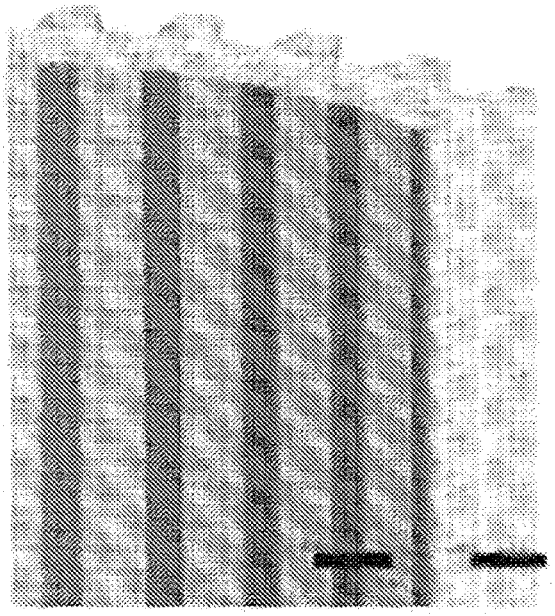

A finite element analysis of the compressor housing has also been performed. Results of that analysis are shown in FIG. 7B. The maximum stress calculated in the analysis is 61 ksi; however, this maximum stress is a local stress concentration, likely at one of the sharp corners in the design. The scale has been adjusted in the figure so that the maximum stresses shown are 25 ksi. Large areas in the housing reach this maximum stress level. Compressor housing 12 can be machined from a stainless steel rod with a yield strength of (typically) 45 ksi. The stresses in the compressor housing are again well below the yield strength of the housing material.

Figure 8:
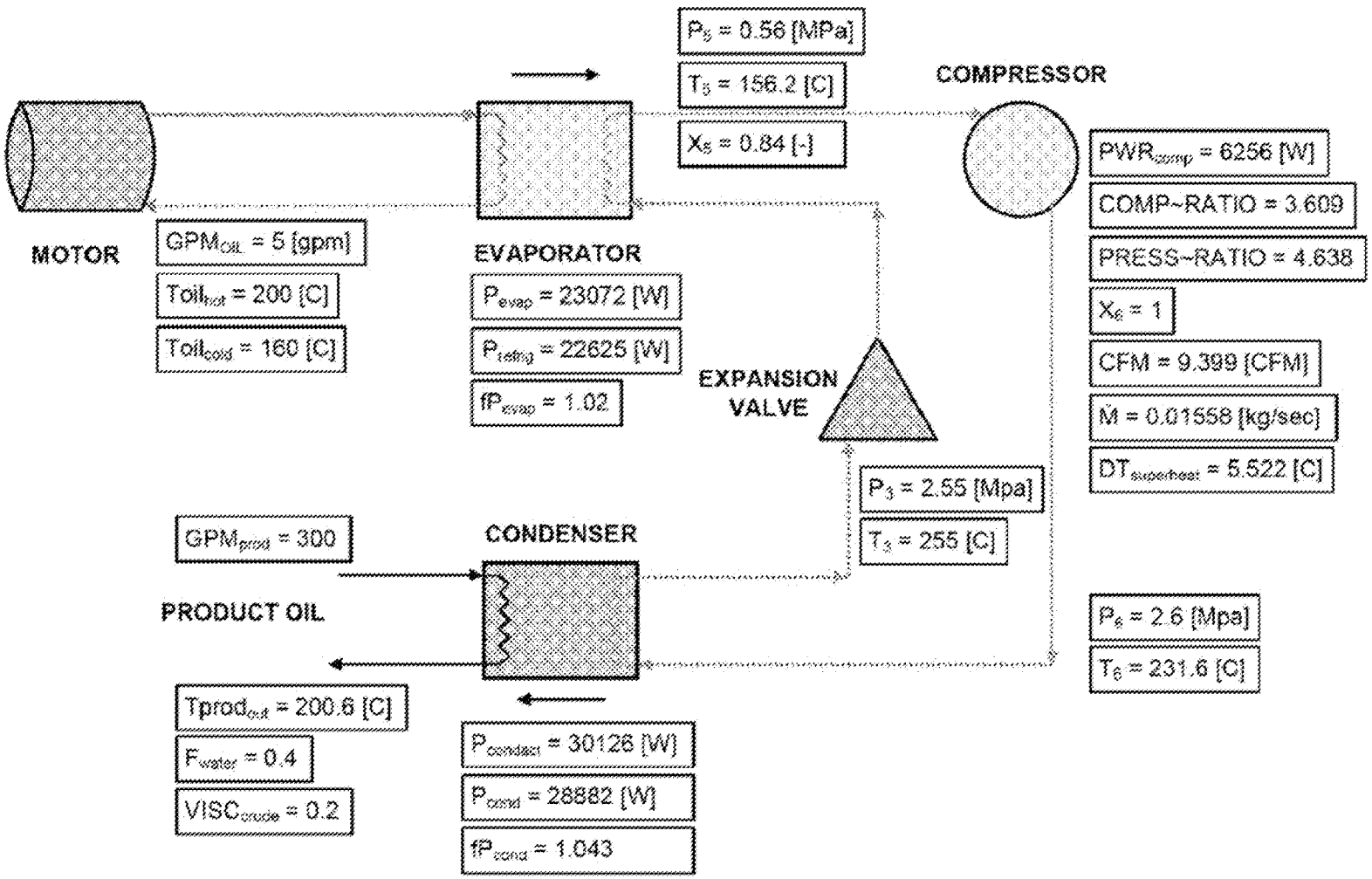
FIG. 8 shows calculations performed to assess operating conditions.

The cooling devices described herein remove heat from internal motor oil to permit the ESP to operate at lower temperatures. By consuming energy directly from the ESP motor to drive the compressor, the cooling devices described herein do not require a separate motor source for operation. At high temperatures in the condenser heat exchanger, the cooling devices can transfer to the product stream a heat load equal to the total heat load absorbed from the motor oil in the evaporator plus the work supplied to the compressor. To determine flow rates, temperatures, pressures, and refrigeration loads, a computer program was developed to calculate all of the state points in the thermodynamic cycle. FIG. 8 shows a block diagram of the cycle. It is taken from the EES (Engineering Equation Solver) code that calculates the cycle parameters. The variables shown are linked to the code and change as the code parameters are manipulated. In this example case, the key inputs are the steam quality at the compressor inlet (84%), the product water cut (40%) and the product viscosity (90 cp). Units are generally metric.

The EES program includes not only a calculation of the steam state points at various points in the thermodynamic cycle but also heat transfer calculations for the condenser and evaporator heat exchangers. With the product oil and internal motor oil flow rates and temperatures, the program calculates the heat transfer capacity (the amount of heat transfer that the heat exchanger is capable of) based on the available heat exchanger area for a refrigerator that will fit in the 30 ft length requirement. The heat transfer calculations are for the tube-in-tube evaporator design and the condenser with a finned housing. In FIG. 8, $P_{evap}$ is the refrigeration load that the evaporator heat exchanger can provide while $P_{refrig}$ is what is required to cool the internal motor oil by 40° C. with the oil flowing past the evaporator coils at 5 gpm. The ratio of the two of $fP_{evap}\approx 1.0$ shows that the evaporator is sized correctly. Similarly, $P_{condact}$ is the heat transfer rate that the condenser heat exchanger can reject to the product stream while $P_{cond}$ is what is required by the thermodynamic cycle. When $fP_{cond}>1.0$, the condenser is oversized. When $fP_{cond}<1.0$, the condenser is undersized. For the example shown in FIG. 8, both the evaporator and condenser heat exchangers have sufficient capacity to transfer the required heat loads.

As illustrated in FIG. 8, 22.6 kW are required to cool the internal motor oil from 200° C. to 160° C. in the evaporator heat exchanger. Thus, the refrigerator sized in FIG. 8 is extracting a considerable portion of the 28 kW total heat generation rate in the baseline ESP motor. To achieve this refrigeration capacity, the compressor must consume 6.3 kW or 8.4 hp. The compressor's power consumption was calculated assuming a compressor isentropic efficiency of 66%, which is typical of a reciprocating compressor. This power will be directly extracted from the ESP motor. Our baseline motor is a 228 hp motor. Therefore, the refrigerator will consume less than 5% of the total motor output.

Figure 9A:
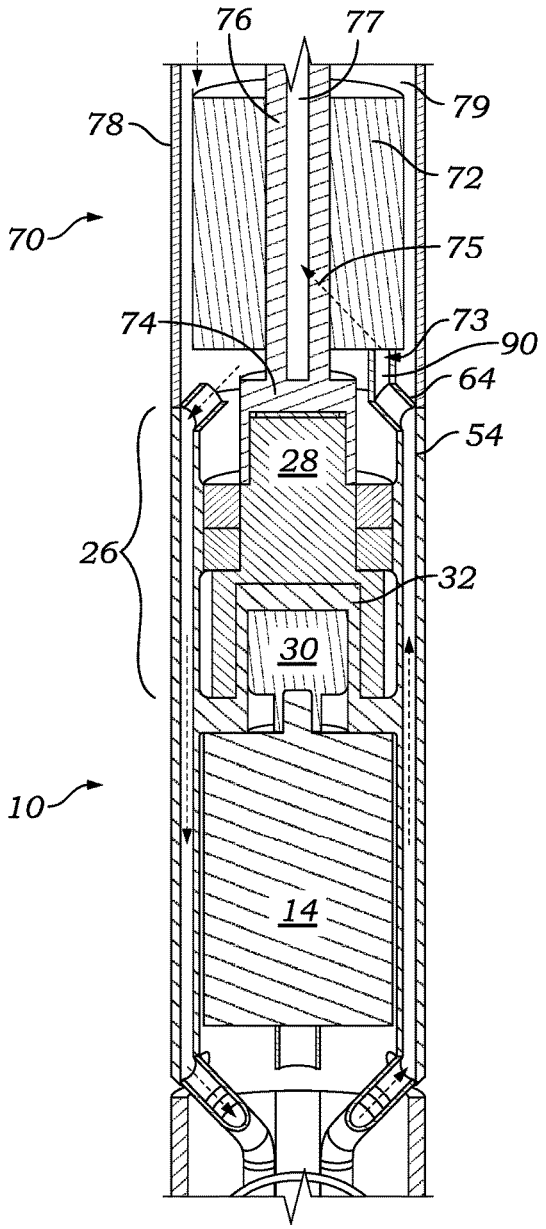
FIGS. 9A-9C show cross-sectional side views of subsystems of an ESP cooling system in accordance with certain example embodiments.
Figure 9C:
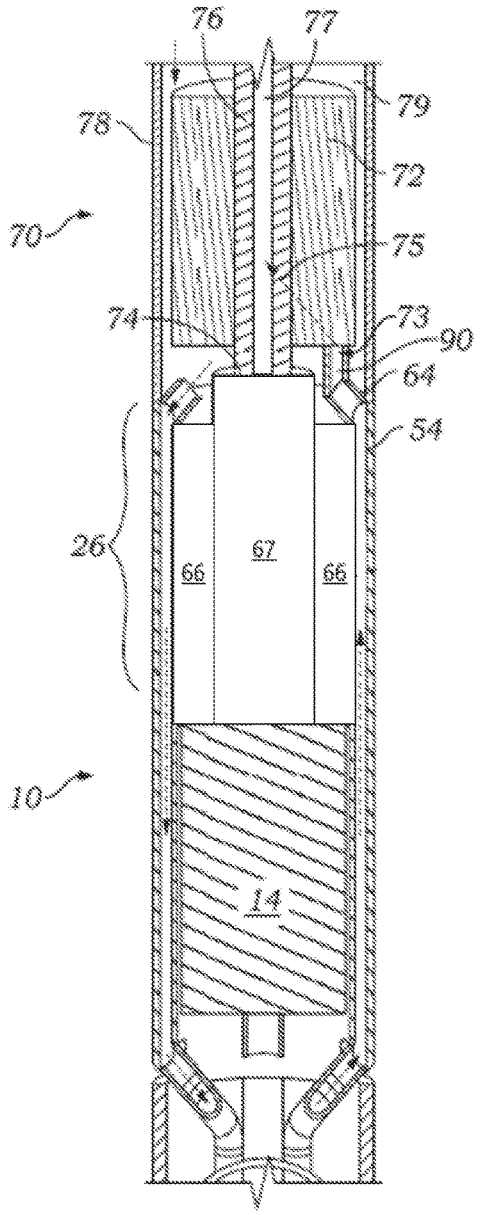
Figure 9B:
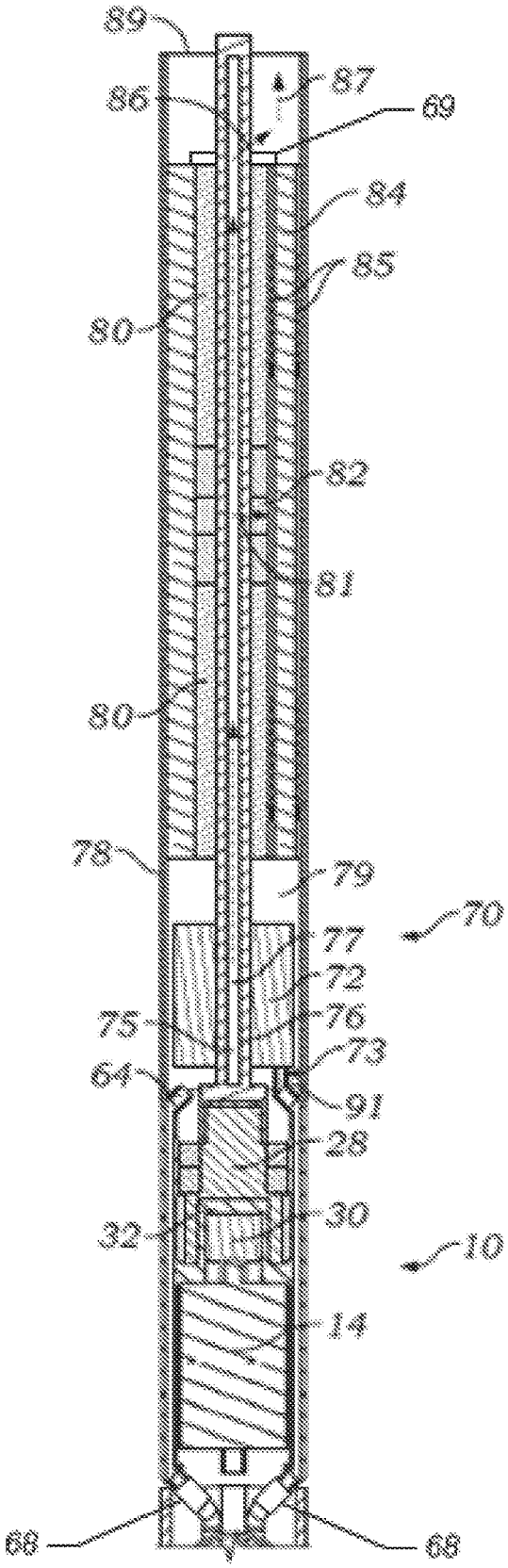

FIGS. 9A-9C show cross-sectional side views of ESP cooling systems in accordance with certain example embodiments. Specifically, FIG. 9A shows a cross-sectional side view of the compressor system 14 of the cooling device 10 and the bottom of the motor 70 of the ESP. FIG. 9B shows a cross-sectional side view of the compressor system 14 of the cooling device 10 and the entire motor 70 of the ESP. FIG. 9C shows a cross-sectional side view of another compressor system 14 of the cooling device 10 and the bottom of the motor 70 of the ESP.

In certain example embodiments, the motor 70 is coupled to the cooling device 10. For example, as shown in FIGS. 9A-9C, the bottom end of the motor 70 can have a coupling system that couples to a complementary coupling system disposed near the compressor system 14 at the top end of the cooling device 10. The motor 70 can be coupled to the cooling device 10, directly or indirectly, in one or more of a number of ways. For example, the motor 70 and the cooling device 10 can have mating threads disposed thereon to allow the motor 70 and the cooling device 10 to threadably couple to each other. As another example, the motor 70 and the cooling device 10 can have apertures that can receive one or more coupling devices (e.g., bolts) that are used to couple the motor 70 and the cooling device 10 to each other.

When the motor 70 and the cooling device 10 are coupled to each other, the manifold 64 (also called a cooling device passageway) of the cooling device 10 and one or more passageways 73 within the motor 70 can be aligned with and coupled to each other. In such a case, the manifold 64 and the passageways 73 can form a sealed coupling with each other when the cooling device 10 and the motor 70 become coupled to each other. The passageways 73 can be disposed in various portions of the motor 70 and can be used to circulate working fluid throughout the motor 70. For example, the passageways 73 can be disposed in a cavity 77 of the shaft 76 (also called a shaft passageway). As another example, as shown in the cross-sectional view of the motor 70 in FIG. 10, the passageways 73 can be disposed in one or more channels 85 in the stator 84 (also called stator passageways).

In such a case, the passageway 73 can start at the manifold 64, travel through a channel 91 to a fluid circulating device 72 (e.g., a pump), flow through a channel 75 disposed toward the bottom of the shaft 76 to the cavity 77 of the shaft 76, then flow through another channel 86 disposed toward the top of the shaft 76 to a header section 87 at the top of the motor 70, then through the channels 85 in the stator 84, and back to the manifold 64 or other part of the cooling device 10 that feeds to the passageways 54 of the cooling device 10. When the cooling device 10 and the motor 70 are coupled to each other, and when the fluid circulating device 72 is operating, the working fluid can flow through the passageways 73 of the motor 70 to absorb heat from the motor and through the passageways 54 of the cooling device 10 to cool the working fluid. In some cases, at least a portion of the working fluid can also flow from the shaft 76 through a gap 97 between the rotor 80 and the stator 84. In any case, the passageway 54 of the cooling device 10 and the passageway 73 of the motor 70 can form a substantially closed loop.

Figure 10:
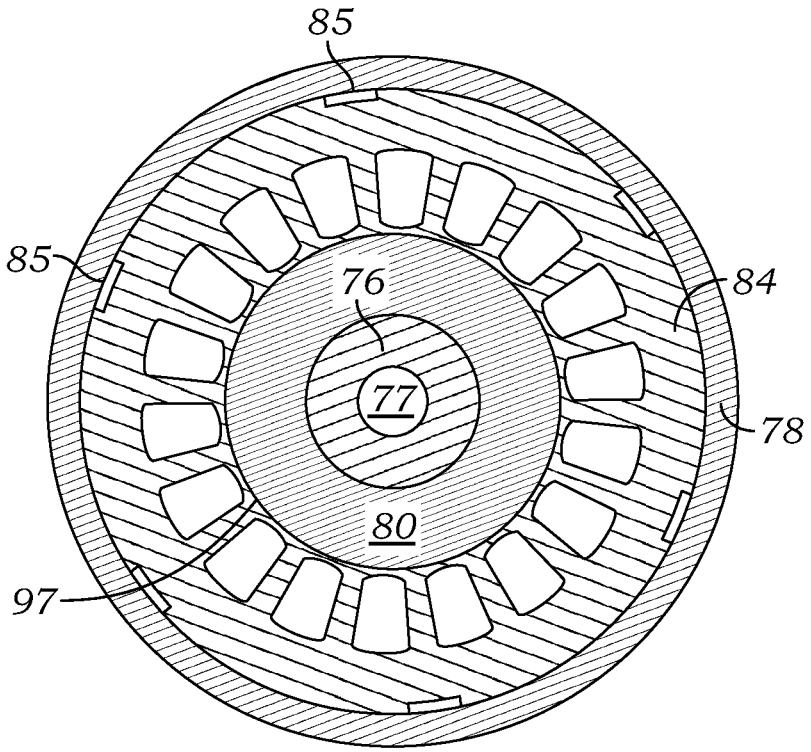
FIG. 10 shows a cross-sectional top view of a motor of an ESP cooling system in accordance with certain example embodiments.

In addition to the passageways 73 and the coupling system, the motor 70 can include one or more of a number of features. For example, the motor 70 can include a motor housing 78 that forms a cavity inside of which the motor is disposed. The motor housing 78 of the motor 70 can have one or more of a number of shapes when viewed cross-sectionally from above. For example, as shown in FIG. 10, the motor housing 78 can be substantially cylindrical when viewed cross-sectionally from above. Further, the motor housing 78 can have a top end 89 and a bottom end 88.

The shaft 76 of the motor 70 can be oriented vertically within and between the top end 89 and the bottom end 88 of the motor housing 78. In such a case, the shaft 76 can be substantially centered within the motor housing 78 along the length (between the top end 89 and the bottom end 88) of the motor housing 78. The bottom end of the shaft 76 can be coupled to a drive system (e.g., coupling system 26) of the cooling device 10. In such a case, as the shaft 76 rotates, the shaft 76 causes a portion of the drive system of the cooling device 10 to rotate, which provides energy to operate one or more components (e.g., the compressor system 14) of the cooling device 10.

The drive system of the cooling device 10 can be configured to use one or more of a number of technologies. For example, the drive system can include a coupling system 26, as shown in FIG. 2 above, where the top end of the coupling system 26 is driven by the shaft 76, while the bottom end of the coupling system 26 (disposed at the first end 22 of the cooling device 10) drives one or more components (e.g., the compressor system 14) of the cooling device 10. In such a case, the coupling system 26 can be magnetic (as shown in FIGS. 9A and 9B), fluid-based (as shown in FIG. 9C), any other technology, or any combination thereof. When a coupling system 26 is fluid-based, as shown in FIG. 9C, the coupling system 26 of the drive system can include a torque converter 67, where the top end of the torque converter 66 is driven by the shaft 76, while the bottom end of the torque converter 67 (disposed at the first end 22 of the cooling device 10, in place of the magnetic coupling system 26 shown, for example, in FIGS. 1B, 9A, and 9B) drives one or more components of the cooling device 10.

In certain example embodiments, a fluid coupling system 26 can include one or more clutches 66 (or similar devices) that are coupled to a component (e.g., compressor system 14, fluid circulating device 72) of the cooling device 10 and/or the motor 70 to control the operation (e.g., on, off, increase speed, decrease speed) of such component. For example, the one or more clutches 66 can be disengaged if the compressor system 14 fails so that the compressor system 14 does not bleed power from the motor 70. In addition, or in the alternative, one or more valves 68 can be disposed in the passageways 73 within the motor 70 and/or the passageways 54 within the cooling device 10. In such a case, the valve 68 can be closed to isolate a portion of a passageway 73 within the motor 70 and/or a passageway 54 within the cooling device 10. Each clutch 66 and/or valve 68 can be controlled automatically or remotely by a user. In some cases, one or more valves 68 can operate automatically if a clutch operates.

The shaft 76 can be a single, continuous piece or a number of shafts that are coupled to each other end-to-end so that the multiple shafts act in unison as a single shaft. In either case, in addition to the channel 86 disposed toward the top of the shaft 76, there can be one or more other channels 81 in the shaft 76 that are positioned between the channel 86 disposed toward the top of the shaft 76 and the channel 75 toward the bottom of the shaft 76. In such a case, a regulator 69 (or similar device) can be used to divert some of the working fluid to go through an additional channel 81 while allowing the remainder of the working fluid to continue up within the cavity 77 of the shaft 76, eventually flowing to another (e.g., adjacent) stator or another portion of the same stator. These additional channels 81 in the shaft 76 can be used to lubricate bearings 82 (or other similar components that assist in the operation of the motor 70) and/or to connect to channels 85 in the stator 84. When there are multiple shafts, the cavity 77 running within the shafts can be substantially continuous.

As shown in FIGS. 9A and 9C, the motor 70 can have a single rotor 80 and stator 84 disposed within the motor housing 78. Alternatively, as shown in FIG. 9B, the motor 70 can have multiple motors, which means that there are multiple rotors 80 and stators 84 disposed within the motor housing 78. As yet another alternative, the motor 70 can have a single rotor 80 and multiple stators 84. In such a case, when there are multiple stators 84, the stators 84 can be coupled to each other or otherwise positioned end-to-end within the motor housing 78. Regardless of the number of stators 84, the shaft 76 can be disposed within the approximate center of each stator 84 along the length of the stator 84, as shown in FIG. 10.

Also, regardless of the number of stators 84, a stator 84 can have multiple channels 85 disposed therein. These channels 85 can be aligned with a channel (e.g., channel 86, channel 81) in the shaft 76 and/or with another channel 85 (for example, as from an adjacent stator 84). Finally, regardless of the number of stators 84 and rotors 80, each stator 84 and/or rotor 80 can be removed from the motor housing 70 and replaced by a user. This allows for maintenance and/or replacement of a stator 84 and/or a rotor 80 without having to replace the entire motor 70.

Using the cooling device 10 coupled to the motor 70, the motor 70 can be cooled. For example, working fluid can be received from the cooling device 10 at a first temperature in at least one passageway 73 disposed in a bottom end 88 of the motor 70. Then, the working fluid can be circulated through the passageways 73 disposed in another portion of the motor 70. At this point, heat transfers from the motor 70 to the working fluid, which causes the working fluid to be at a second, higher temperature relative to the first temperature. Subsequently, the working fluid is sent back to the cooling device 10. The process can then be repeated, and in many cases, the process is continuous for some period of time. For example, while the compressor system 14 of the cooling device 10 is operating, the process is continuous.

In certain example embodiments, one or more sensors can be used in the cooling device 10 and/or the motor 70 to help determine whether some or all of the components of the cooling device 10 and/or the motor 70 are operating properly. Such sensors can measure any of a number of factors, including but not limited to the flow rate of the working fluid, the pressure of the working fluid within a passageway, the temperature of a stator 85, and an amount of power consumed by the compressor system 14.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A cooling system for an electric submersible pumping system, the cooling system comprising:

a cooling device comprising at least one cooling device passageway;

a plurality of motors coupled to the cooling device, wherein each motor of the plurality of motors comprises:

a substantially cylindrical motor housing having a bottom end and a top end;

a coupling system disposed at the bottom end of the motor housing, wherein the coupling system mechanically couples to a complementary coupling system of the cooling device;

a shaft oriented vertically between the top end and the bottom end of the motor housing and substantially centered within the motor housing, wherein the shaft is coupled to a drive system of the cooling device;

a shaft passageway disposed within the shaft;

at least one stator passageway disposed within a plurality of channels in a stator of the motor, wherein the shaft passageway and the at least one stator passageway couple to the at least one cooling device passageway where a top end of a cooling device housing meets the bottom end of the motor housing; and at least one regulator disposed within the shaft; and working fluid circulating through the at least one cooling device passageway and the shaft passageway, wherein the at least one regulator diverts a first portion of the working fluid through the at least one stator passageway in one of the stators while allowing a second portion of the working fluid to flow through the at least one stator passageways disposed in a remainder of the stators of the plurality of motors, wherein each stator of the plurality of motors is coupled to an adjacent stator so that the at least one stator passageway is continuous among the plurality of motors.

2. The cooling system of claim 1, wherein the shaft comprises a plurality of shafts, wherein each shaft of the plurality of shafts comprises the shaft passageway, wherein the shaft passageway in a shaft of the plurality of shafts is coupled to an adjacent shaft passageway disposed in an adjacent shaft.

3. The cooling system of claim 1, wherein each motor of the plurality of motors is replaceable within the motor housing.

4. The cooling system of claim 1, wherein the drive system comprises a magnetic coupling system positioned at the top end of the cooling device housing, wherein the magnetic coupling system comprises a first side that can be driven by the shaft of the motor and a second side that can drive a compressor of the cooling device.

5. The cooling system of claim 1, wherein the drive system comprises a torque converter positioned at the top end of the cooling device housing, wherein the torque converter comprises a first side that can be driven by the shaft of the motor and a second side that can drive a compressor of the cooling device.

6. The cooling system of claim 1, wherein the drive system comprises a fluid coupling system positioned at the top end of the cooling device housing, wherein the fluid coupling system comprises a first side that can be driven by the shaft of the motor and a second side that can drive a compressor of the cooling device.

7. The cooling system of claim 1, wherein the at least one stator passageway extends through the stator from the top side of the motor housing to the bottom side of the motor housing, wherein the at least one stator passageway is sized to allow the working fluid to pass therethrough.

8. The cooling system of claim 1, wherein the motor further comprises:

at least one fluid circulating device disposed within the motor housing, wherein the at least one fluid circulating device circulates the working fluid through the at least one cooling device passageway, the shaft passageway, and the at least one stator passageway.

9. The cooling system of claim 8, wherein the at least one cooling device passageway, the shaft passageway, and the at least one stator passageway form a substantially closed loop.

10. The cooling system of claim 1, further comprising:

a clutch coupled to a compressor of the cooling device, wherein the clutch turns the compressor on and off.

11. The cooling system of claim 10, further comprising:

at least one valve that operates in conjunction with the clutch, wherein the at least one valve closes to isolate a portion of the at least one cooling device passageway when the clutch turns the compressor off.

12. The cooling system of claim 10, wherein the cooling device comprises:

a substantially cylindrical cooling device housing having a top end, a bottom end, a length defined as the distance between the top end and the bottom end, and a diameter; and the compressor, a condenser, a pressure reduction device, and an evaporator contained within the cooling device housing, wherein the drive system is disposed within the cooling device housing toward the top end of the cooling device housing, wherein the drive system is coupled to the compressor, wherein the drive system generates energy to operate the compressor, wherein the at least one cooling device passageway is disposed within the cooling device housing and connects the compressor, the condenser, the pressure reduction device, and the evaporator, and wherein the coupling system is disposed at the top end of the cooling device housing.

13. A motor of an electric submersible pumping system, wherein the motor comprises:

a substantially cylindrical housing having a bottom end and a top end;

a coupling system disposed at the bottom end of the housing, wherein the coupling system mechanically couples to a complementary coupling system of a cooling device;

a shaft oriented vertically between the top end and the bottom end of the housing and substantially centered within the housing, wherein the shaft is coupled to a drive system of the cooling device;

a plurality of rotors coupled to the shaft;

a plurality of stators disposed around the plurality of rotors;

a shaft passageway disposed within the shaft;

at least one regulator disposed within the shaft; and at least one stator passageway disposed within the plurality of stators, wherein the shaft passageway is configured to couple to at least one cooling device passageway where a top end of the cooling device meets the bottom end of the housing, wherein the at least one stator passageway is continuous throughout the plurality of stators, and wherein the at least one regulator is configured to divert a first portion of working fluid through the at least one stator passageway in one of the stators while allowing a second portion of the working fluid to flow through the at least one stator passageway disposed in a remainder of the stators.

14. A cooling device of an electric submersible pumping system, wherein the cooling device comprises:

a substantially cylindrical cooling device housing having a top end, a bottom end, a length defined as the distance between the top end and the bottom end, and a diameter;

a compressor, a condenser, a pressure reduction device, and an evaporator contained within the cooling device housing;

a drive system disposed within the cooling device housing toward the top end of the housing, wherein the drive system is coupled to the compressor, wherein the drive system generates energy to operate the compressor;

at least one cooling device passageway disposed within the cooling device housing and that connects the compressor, the condenser, the pressure reduction device, and the evaporator;

a coupling system disposed at the top end of the cooling device housing;

a clutch coupled to the compressor of the cooling device, wherein the clutch turns the compressor on and off; and at least one valve that operates in conjunction with the clutch, wherein the at least one valve closes to isolate a portion of the at least one cooling device passageway when the clutch turns the compressor off.

15. A cooling system for an electric submersible pumping system, the cooling system comprising:

a cooling device comprising at least one cooling device passageway;

a clutch coupled to a compressor of the cooling device, wherein the clutch turns the compressor on and off;

at least one valve that operates in conjunction with the clutch, wherein the at least one valve closes to isolate a portion of the at least one cooling device passageway when the clutch turns the compressor off;

a plurality of motors coupled to the cooling device, wherein each motor of the plurality of motors comprises:

a substantially cylindrical motor housing having a bottom end and a top end;

a coupling system disposed at the bottom end of the motor housing, wherein the coupling system mechanically couples to a complementary coupling system of the cooling device;

a shaft oriented vertically between the top end and the bottom end of the motor housing and substantially centered within the motor housing, wherein the shaft is coupled to a drive system of the cooling device;

a shaft passageway disposed within the shaft; and at least one stator passageway disposed within a plurality of channels in a stator of the motor, wherein the shaft passageway and the at least one stator passageway couple to the at least one cooling device passageway where a top end of a cooling device housing meets the bottom end of the motor housing; and working fluid circulating through the at least one cooling device passageway and the shaft passageway.

* * * * *